US006539680B2

(12) United States Patent
Kunz et al.

(10) Patent No.: US 6,539,680 B2
(45) Date of Patent: Apr. 1, 2003

(54) PAPER BEAD AND TRIM

(75) Inventors: Roland Kunz, Omaha, NE (US); Roy R Rantilla, Niles, OH (US)

(73) Assignee: Phillips Manufacturing Co., Omaha, NE (US)

( * ) Notice: Subject to any disclaimer, the term of this patent is extended or adjusted under 35 U.S.C. 154(b) by 0 days.

(21) Appl. No.: 09/967,335

(22) Filed: Sep. 28, 2001

(65) Prior Publication Data

US 2002/0073639 A1 Jun. 20, 2002

Related U.S. Application Data

(63) Continuation-in-part of application No. 09/573,022, filed on May 17, 2000, now Pat. No. 6,295,776.

(51) Int. Cl.[7] ..... E04B 1/00; E04F 13/06

(52) U.S. Cl. ..... 52/256; 52/255; 52/287.1

(58) Field of Search ..... 52/255, 256, 257, 52/287.1

(56) References Cited

U.S. PATENT DOCUMENTS 1,804,564 A * 5/1931 McChesney
3,391,509 A * 7/1968 Fruman
4,313,991 A * 2/1982 Lamb ..... 428/131
5,138,810 A * 8/1992 Kartler ..... 52/254
5,246,775 A * 9/1993 Loscuito
6,295,776 B1 * 10/2001 Kunz et al. ..... 52/255
D457,658 S * 5/2002 Harel ..... D25/121
D457,972 S * 5/2002 Harel ..... D25/121
D458,388 S * 6/2002 Harel ..... D25/119
2002/0005023 A1 * 1/2002 Ford ..... 52/514
2002/0035809 A1 * 3/2002 Smythe ..... 52/255
2002/0134035 A1 * 9/2002 Koenig, Jr. et al.

* cited by examiner

*Primary Examiner*—Robert Canfield

(57) ABSTRACT

A corner bead is of the tape-on type, having an elongated metal core strip with a longitudinal arcuate nose and a pair of flanges extending outwardly from the nose at approximately a right angle. A cover strip of paper is bonded to the exterior surface of the core strip, and includes wings which project outwardly beyond the extent of the flanges. The cover strip is formed of a stock paper having high abrasion resistance, tensile strength, and which is dimensionally stable on contact with wet joint compound.

4 Claims, 2 Drawing Sheets

PAPER BEAD AND TRIM

CROSS-REFERENCES TO RELATED APPLICATIONS

This is a Continuation-in-part of Ser. No. 09/573,022, filed May 17, 2000, entitled "Corner Bead Drywall Trim and Method of Manufacture", issued Oct. 2, 2001, U.S. Pat. No. 6,295,776.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to drywall construction, and more particularly to an improved corner bead and trim products with paper wings.

(2) Background Information

Current building construction utilizes sheets of drywall, commonly referred to as "wallboard", to form the surfaces of interior walls of buildings. Drywall, or wallboard, is formed of sheets of plaster which are sheathed in an outer wrapping of heavy construction paper.

In wallboard construction, the joint between adjacent sheets of wallboard is usually covered by a paper tape extending lengthwise along the joint. The conventional drywall tape is provided in narrow elongated strips of porous paper wound into rolls. The drywall tape is applied to the joints, and then covered with wet plaster or "mud". The plaster is feathered and smoothed along the edges of the tape to conceal the tape edges and form a smooth unmarred surface at the wallboard joints.

It is often necessary to cut the wallboard to form a corner, which thereby exposes the plaster contained between the heavy paper sheets. This exposed plaster tends to crumble unless these edges are protected. To finish exterior corners in wallboard construction, metal corner beads are typically installed. Such corner beads are conventionally formed by roll-forming from an elongated strip of sheet metal, and provide a rounded nose with two mounting flanges extending at substantially right angles from the opposing sides of the nose. These mounting flanges are often knurled or embossed to provide a rough surface so that the joint compound will adhere when the corner is finished.

The corner bead is installed by securing the mounting flanges along the surface of the drywall panels adjacent to the corner by nails or the like. Wet plaster is then smoothed into place to cover the metal flanges, and edges of the plaster are smoothed and feathered to cover and conceal the metal edges.

A second type of corner bead is referred to as a "tape-on" bead. Tape-on corner beads utilize paper wings to secure a metal corner angle in position, rather than using nails or other fasteners. Wet plaster or joint cement for finishing the corner will normally adhere significantly better to the paper cover strip of tape-on beads, than to the exposed metal of conventional nail-on beads. Nail-on beads are also typically more susceptible to developing crack lines along the outer edges of the flanges, than are tape-on beads. In addition, tape-on beads are more tolerant of dimensional and geometric changes in the underlying construction framing than are nail-on beads with their rigid mechanical attachment to the construction framing.

One of the main problems with prior art tape-on bead is the use of standard joint/drywall tape-on the bead. Such drywall tape is very fibrous, which is good for bond strength, but poor for appearance. During the application of joint cement over the tape, to adhere the corner bead to the drywall, fibers will project and protrude with only minimal contact by the application tools. These fibers will ball up during the course of sanding of the joint cement for the final finish, thereby detracting from the finished appearance of the corner.

One method for improving protection against adverse abrasion of this paper strip is disclosed in U.S. Pat. Nos. 5,613,335 and 5,836,122, both to Rennich et al. These patents disclose a paper bead (tape-on bead) utilizing a paper layer which is uniformly impregnated throughout its thickness with latex or similar strengthening compound with a high wet strength so as to make the paper strip resistant to scuffing and abrasion throughout its thickness. This impregnated stock paper would have a high pick it resistance or surface fiber bond, and would effectively inhibit the separation of surface fibers during application on wallboard, thereby providing a good finished appearance in installation. However, the applicants herein have found that paper of this type, which has been impregnated with latex or the like, exhibits poor joint compound bonding properties. Bond Strength Test ASTM C 474 is required by specifications ASTM C 475 and ASTM C 1047 for wallboard accessories manufactured from steel and paper in combination. This ASTM test observes the result of peeling the paper away from a joint compound bond made under controlled conditions.

In addition, it is difficult to apply a uniform layer of joint cement under the paper wings, in order to attach the bead or trim to the drywall. This, in turn, results in the application of either too much or too little "mud", and affects the appearance of the joint.

BRIEF SUMMARY OF THE INVENTION

It is therefore a general object of the present invention to provide improved tape-on on corner bead and trim with paper wings which exhibits high bond strength.

Yet another object is to provide an improved tape-on corner bead which will firmly bond to the drywall construction, the supporting metal corner angle, as well as the joint cement applied over the top thereof.

A further object of the present invention is to provide a method for constructing tape-on corner bead which permits secure attachment of the corner bead to wallboard.

These and other objects will be apparent to those skilled in the art.

The corner bead of the present invention is of the tape-on type, having an elongated metal core strip with a longitudinal arcuate nose and a pair of flanges extending outwardly from the nose. A strip of paper is bonded to the exterior surface of the core strip, and includes wings which project outwardly beyond the extent of the flanges. The wings have a plurality of dimples projecting from a rearward face.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
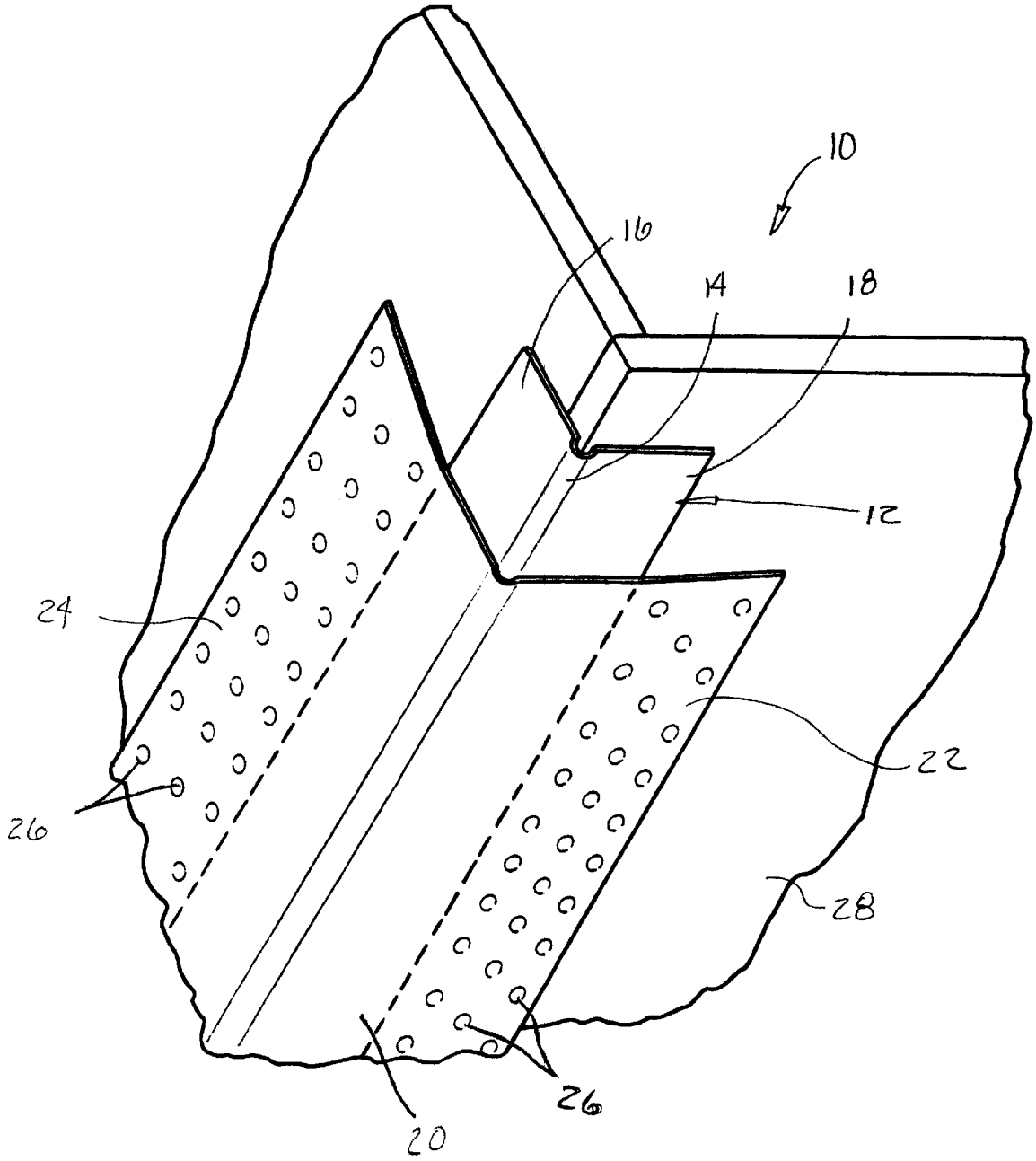
FIG. 1 is a perspective view of the corner bead of the present invention exploded away from an exterior corner of wallboard construction.
Figure 3:
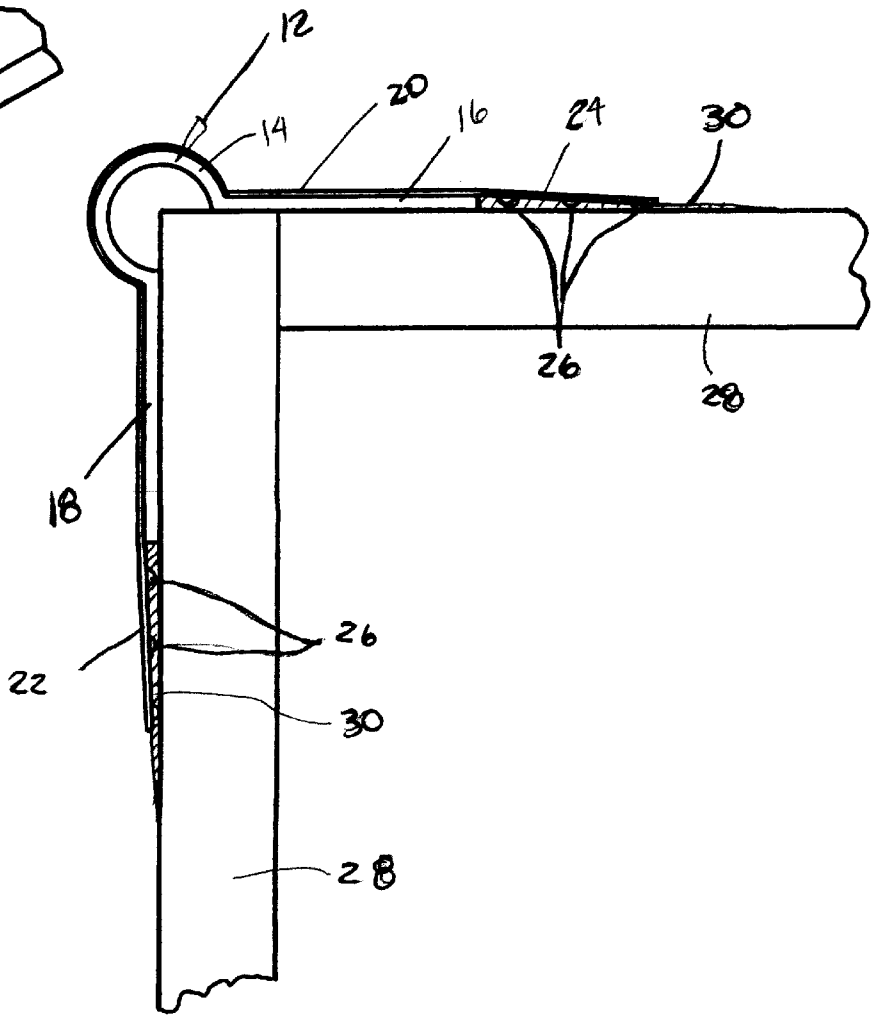
FIG. 3 is an enlarged top view of the corner bead mounted on a corner of wallboard construction.

Referring now to the drawings, a corner bead of the present invention is designated generally at 10 and includes an elongated metal core strip 12 formed with a central arcuate longitudinal channel forming a nose 14, with flanges 16 and 18 extending outwardly from each edge of the channel of nose 14 at an angle.

Core 12 is preferably a galvanized steel strip having a thickness of approximately 0.014 inches which has been roll-formed. In the preferred embodiment, the flanges are ¾ of an inch in length, measured from nose 14. The typical core strip nose will have an outside radius of up to about 1.5 inches, and project outwardly from the plane of the flanges approximately 0.033 inches, to provide space to receive joint cement, to cover and "dress" the corner.

In the method of assembly of the corner bead, a continuous steel strip first passes through a preforming roll forming section. The preforming section, by means of progressive contoured rolls, forms the steel core strip 12 into a cross-section that begins to conform to the desired finished shape of the corner bead. This preformed steel strip then progresses into an assembly section.

A continuous length of paper strip 20 enters a paper conditioning section, wherein mechanical abrasion breaks some of the surface bond of the paper fibers and simultaneously, by means of a roller die, forms a plurality of small dimples in designated regions of the paper. In an alternative embodiment, the surface of the paper is not abraded, but a plurality of dimples are formed in designated regions of the paper. The paper strip 20 then progresses to the assembly section for attachment to the preformed core 12.

In the assembly section, the paper strip 20 is guided through a preheating section that brings the paper to a suitable elevated temperature to improve the subsequent adhesive bonding. It then passes against a slot type hot melt adhesive applicator head, which applies a stripe of adhesive to the paper. The design of the slot head, along with control over the relative travel speed of the paper strip and the rate of flow of adhesive, regulate the location, width and thickness of the adhesive stripe. The heated paper strip 20 with adhesive thereon is then guided into contact with the preformed steel core. The assembly of steel core, adhesive and paper strip then progresses into a finish forming section.

In the finish forming section, the assembly passes through a second series of contoured forming rolls. These rolls form the assembly into the desired finished cross-section section shape of the corner bead, and simultaneously provides the necessary pressure to achieve the bond between the paper strip 20 and steel core 12. The bonded and formed corner bead then progresses to a cut off section where the corner bead 10 is sheared into the desired finished length.

As shown in the drawings, the preferred embodiment of the invention utilizes a paper cover strip 20 with wings 22 and 24 affixed to flanges 16 and 18 respectively, and extending beyond flanges 16 and 18. The paper preferably has a thickness of approximately 0.007 inches and will project beyond flanges 16 and 18 approximately ⅝ of an inch. Prior art versions of the invention utilize very small diameters holes that are pierced or cleanly punched through the paper. This improvement presses an indented profile into the paper in such a way that some of the paper fibers are burst to create a rough, fibrous opening, yet leave enough embossed edges to provide a standoff profile. These dimples 26 are arranged in approximately ⅛ inch to 3⁄16 inch spacings. Each dimple 26 is embossed to an initial raise height of approximately 0.007 inches to 0.014 inches. Each dimple 26 is approximately 0.035 inches by 0.035 inches at its base on the raised rearward surface of the paper wing. Dimples 26 may be round, square, oblong, or similar shape.

Preferably, dimples 26 are formed with sufficient die pressure to burst the paper fibers open to a degree that light is visible through the dimple 26, although subsequent handling may make hanging chad block some of the openings.

Figure 2:
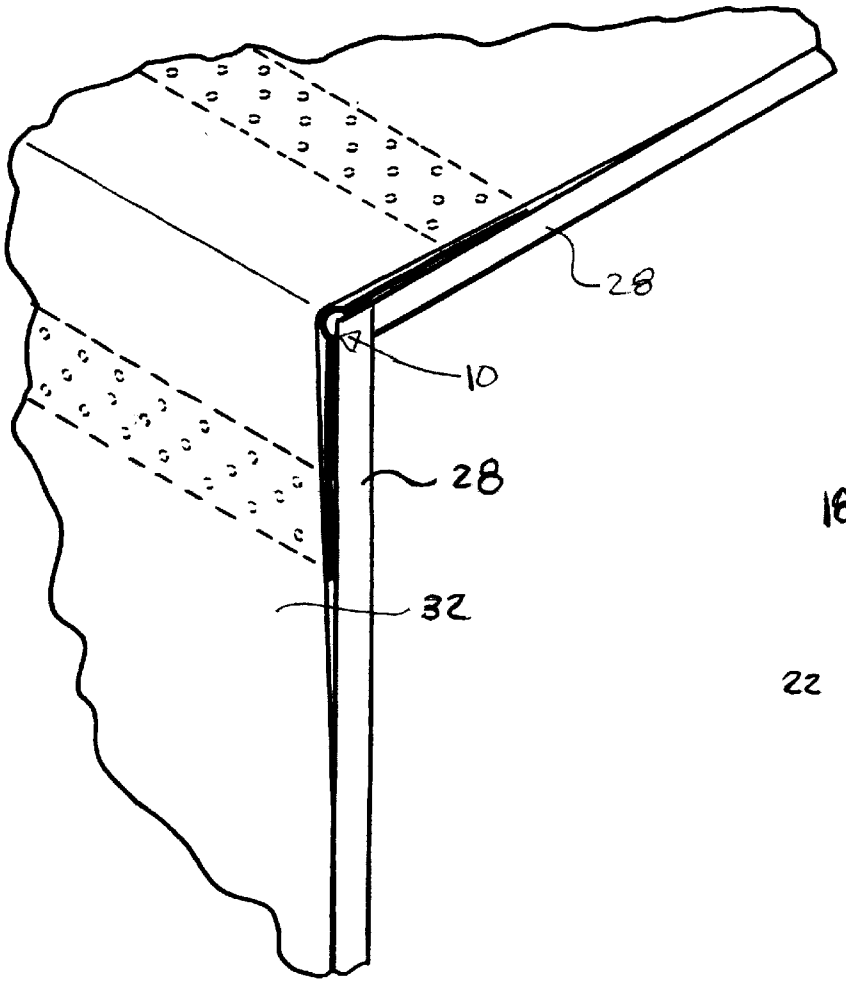
FIG. 2 is a perspective view of a corner of wallboard construction with the corner bead of the present invention thereon, and covered with joint cement for a finished surface.

A layer of joint cement or "mud" 30 is applied to the wallboard under wings 22 and 24 to adhere the wings 22 and 24 to the wallboard 28. Dimples 26 act as standoffs, providing a uniform depth of mud 30 along the entire length of wings 22 and 24, as well as providing anchorage into the joint compound or "mud". This in turn prevents over application of mud, and improves the overall results. An additional layer, or layers of mud 32 are then applied in a conventional manner to cover the entire paper strip 20 from nose 14 outwardly over wings 22 and 24, as shown in FIG. 2. Once coat 32 has dried, the joint cement is sanded and additional layers are applied as necessary for a final finish.

The inventors have found that paper with an off-white tint is preferable, so as to match the color of the drywall facing paper and joint cement. In this way, if a portion of the joint cement is sanded away to reveal the paper strip, the color of the paper strip will closely match the color of the wallboard and will not reveal any stark contrasts.

Whereas the invention has been shown and described in connection with the preferred embodiment thereof, many modifications, substitutions and additions may be made which are within the intended broad scope of the appended claims. More specifically, this invention may be applied to all varieties of drywall accessory or trim, including those types described in ASTM C 1047.

We claim:

1. A tape-on drywall accessory for drywall construction, comprising:

an elongated core strip having inward and outward faces, with an outwardly projecting nose portion extending from end to end, and at least one leg projecting transversely from the nose portion to an edge;

an elongated paper strip affixed to an outward face of the core strip and extending from end to end, with a portion extending transversely beyond the edge of the at least one leg to form a wing; and said wing having a plurality of spaced-apart, uniform-depth depressions formed therein and projecting from an inward face of the wing.

2. The tape-on drywall accessory of claim 1, wherein said depressions are uniformly spaced-apart across a portion of said at least one wing.

3. The tape-on drywall accessory of claim 1, wherein the accessory is a corner bead having a pair of legs projecting from a central nose portion, and wherein said paper strip includes a wing projecting transversely from each leg.

4. The tape-on drywall accessory of claim 1, wherein the core strip is metal.

* * * * *